US012767303B2

(12) United States Patent
Ebuchi

(10) Patent No.: US 12,767,303 B2
(45) Date of Patent: Oct. 20, 2026

(54) OUTBOARD MOTOR AND BOAT

(71) Applicant: YAMAHA HATSUDOKI KABUSHIKI KAISHA, Iwata (JP)

(72) Inventor: Jun Ebuchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 324 days.

(21) Appl. No.: 18/438,614

(22) Filed: Feb. 12, 2024

(65) Prior Publication Data

US 2024/0359786 A1 Oct. 31, 2024

(30) Foreign Application Priority Data

Apr. 26, 2023 (JP) ..... 2023-072163

(51) Int. Cl.
*B63H 20/28* (2006.01)

(52) U.S. Cl.
CPC ..... *B63H 20/28* (2013.01)

(58) Field of Classification Search
CPC ..... B63H 20/00; B63H 20/001; B63H 20/28; B63H 20/285; B63H 21/17; B63H 21/38; F01P 3/202
USPC ..... 440/1, 6, 76, 88 C, 88 D
See application file for complete search history.

(56) References Cited

U.S. PATENT DOCUMENTS

2016/0039510 A1* 2/2016 Shomura ..... B63H 20/14 440/6
2022/0089261 A1* 3/2022 Bruestle ..... B63H 23/321

FOREIGN PATENT DOCUMENTS

CN 101353082 A 1/2009
CN 216332688 U 4/2022
JP 2016-037256 A 3/2016

OTHER PUBLICATIONS

Official Communication issued in corresponding European Patent Application No. 24153176.3, mailed on Sep. 13, 2024, 11 pages.

* cited by examiner

*Primary Examiner* — Tye William Abell
(74) *Attorney, Agent, or Firm* — Keating & Bennett, LLP

(57) ABSTRACT

An outboard motor includes an electric motor, a motor control board to control the electric motor and having one end higher than another end, a case between the electric motor and the motor control board and including a cooling chamber, a supply flow path connected to the cooling chamber of the case to supply refrigerant to the cooling chamber, and a discharge flow path connected to the cooling chamber to discharge the refrigerant from the cooling chamber. A discharge port of the discharge flow path is located at the one end of the motor control board, a supply port of the supply flow path is located at the another end of the motor control board, a lower end of the discharge port is higher than a lower end of the supply port, and a first wall surface of the cooling chamber extends along the motor control board.

9 Claims, 5 Drawing Sheets

OUTBOARD MOTOR AND BOAT

CROSS REFERENCE TO RELATED APPLICATIONS

This application claims the benefit of priority to Japanese Patent Application No. 2023-72163 filed on Apr. 26, 2023. The entire contents of this application are hereby incorporated herein by reference.

BACKGROUND OF THE INVENTION

1. Field of the Invention

The technologies disclosed herein relate to an outboard motor and a boat.

2. Description of the Related Art

A boat is provided with a hull and an outboard motor mounted to a rear portion of the hull. The outboard motor generates thrust to propel the boat. The outboard motor includes a drive source, a propeller, and a transmission that includes a propeller shaft and transmits the drive power of the drive source to the propeller.

An outboard motor including an electric motor as a drive source and a motor control board that controls the electric motor has been disclosed. The outboard motor is also provided with a water jacket through which cooling water flows to cool the electric motor (see, e.g., JP 2016-37256 A).

In an outboard motor provided with a control board (such as a motor control board), the control board is covered by a waterproof cover, e.g., and easily increases in temperature due to heat generated by the drive source (such as the electric motor). Therefore, it is necessary to cool not only the drive source but also the control board. There has been room for improvement in the cooling of control boards provided in outboard motors.

This problem is not limited to electric motors and motor control boards but is common to outboard motors provided with a drive source such as an engine and a control board.

SUMMARY OF THE INVENTION

The present specification discloses technologies that are able to solve the above-mentioned problems.

The technologies disclosed herein can be implemented in the following aspects.

An outboard motor according to a preferred embodiment of the present invention includes an electric motor; a motor control board to control the electric motor and having one end higher than another end; a case between the electric motor and the motor control board and including a cooling chamber; a supply flow path connected to the cooling chamber of the case to supply refrigerant to the cooling chamber; and a discharge flow path connected to the cooling chamber of the case to discharge the refrigerant from the cooling chamber. A discharge port of the discharge flow path in the cooling chamber is located at one end of the motor control board, a supply port of the supply flow path in the cooling chamber is located at the another end of the motor control board, a lower end of the discharge port is higher than a lower end of the supply port, and a first wall surface of the cooling chamber extends along the motor control board.

In this outboard motor, the lower end of the discharge port of the cooling chamber to which refrigerant is supplied is higher than the lower end of the supply port so that the cooling chamber can be filled with refrigerant to a height near the discharge port of the cooling chamber. Moreover, the first wall surface of the cooling chamber extends along the motor control board. Therefore, the entire motor control board can be effectively cooled (e.g., over the entire surface) compared to a configuration in which the first wall surface in the cooling chamber does not extend along the motor control board, for example.

In the above outboard motor, the motor control board and the first wall surface in the cooling chamber may be inclined with respect to a horizontal direction. The outboard motor can effectively cool the motor control board while orienting the motor control board at an angle.

In the above outboard motor, the second wall surface of the cooling chamber located on an opposite side from the motor control board may be inclined in a same direction as the first wall surface of the cooling chamber with respect to the horizontal direction. The outboard motor can drain the used refrigerant from the cooling chamber smoothly to outside of the outboard motor after the refrigerant is supplied to the case.

In the above outboard motor, the motor control board and the first wall surface in the cooling chamber may extend along an up-down direction. The outboard motor can effectively cool the motor control board while orienting the motor control board vertically.

In the above outboard motor, a supply direction of the refrigerant from the supply flow path to the cooling chamber may be opposite to a discharge direction of the refrigerant from the cooling chamber to the discharge flow path. The outboard motor can effectively cool the motor control board while reducing turbulence caused by the momentum of the refrigerant flow from the supply flow path to the cooling chamber and discharging the refrigerant from the cooling chamber.

In the above outboard motor, the supply port may be located at a highest point in the supply flow path. The outboard motor can smoothly fill the cooling chamber with refrigerant, compared to a configuration in which, e.g., the supply port is not located at the highest point in the supply flow path.

In the outboard motor, the discharge port may be located at a lowest point in the discharge flow path. The outboard motor can vent air in the cooling chamber more smoothly compared to a configuration in which the discharge port is not located at the lowest point in the discharge flow path.

The outboard motor may further include an air vent higher than the discharge port, and the discharge flow path may be connected to the air vent. According to the outboard motor, air mixed with refrigerant can be extracted from the air vent connected to the discharge flow path to outside of the outboard motor while effectively cooling the motor control board.

An outboard motor according to another preferred embodiment of the present invention includes a control board oriented so that one end is lower than another end, a case extending along the control board and including a cooling chamber, a supply flow path connected to the cooling chamber of the case to supply a refrigerant to the cooling chamber, and a discharge flow path connected to the cooling chamber of the case to discharge the refrigerant from the cooling chamber. A discharge port of the discharge flow path in the cooling chamber is higher than a supply port of the supply flow path in the cooling chamber, and a wall surface of the cooling chamber extends along the control board from the discharge port to the supply port. The outboard motor can effectively cool the entire control board.

The technologies disclosed herein can be implemented in various aspects, including, e.g., outboard motors, boats provided with outboard motors and hulls, among other configurations and apparatuses.

The outboard motors disclosed herein can effectively cool the entire control boards provided in the outboard motors.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
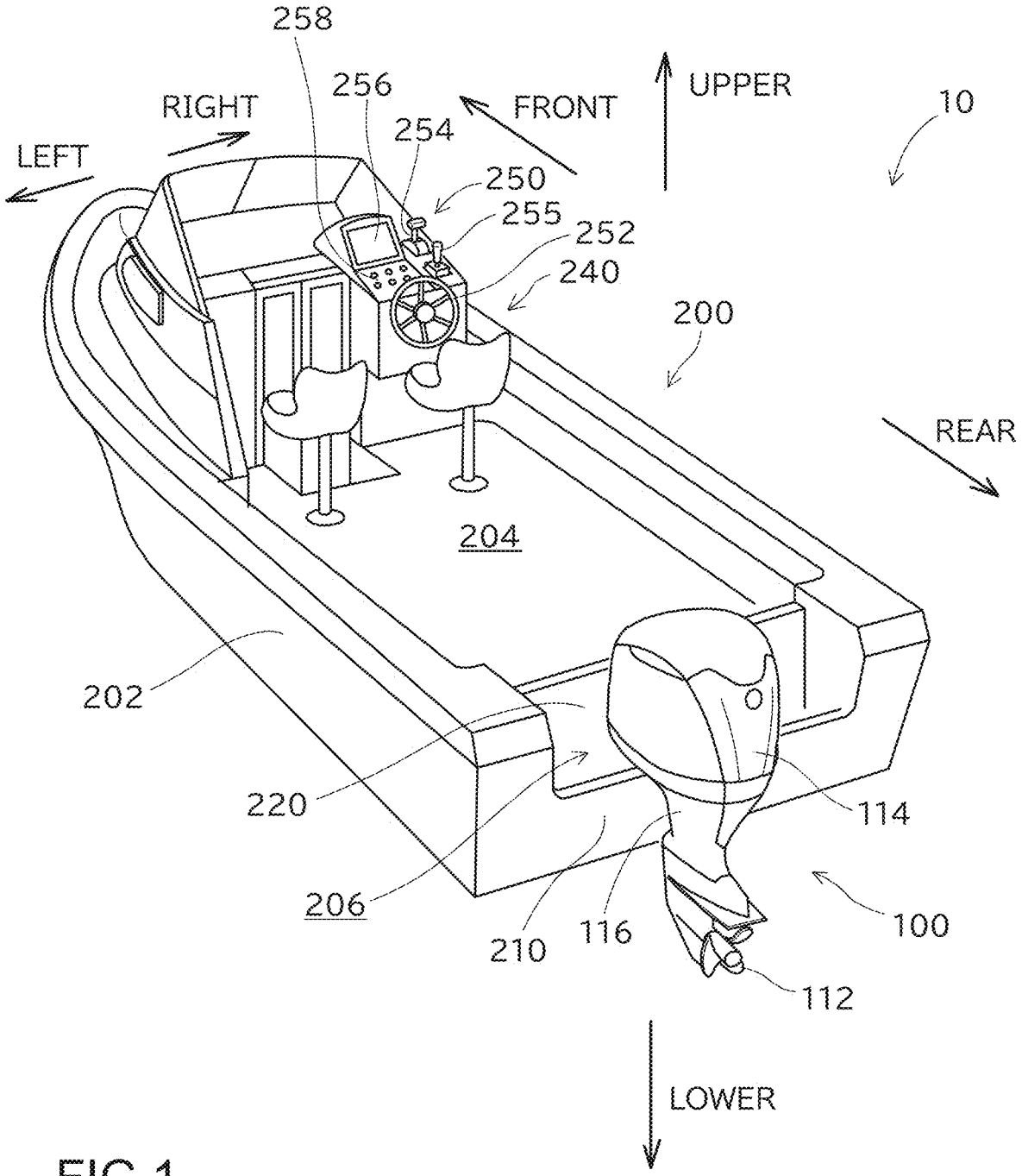
FIG. 1 is a perspective view schematically illustrating a configuration of a boat according to a first preferred embodiment of the present invention.

FIG. 1 is a perspective view schematically illustrating a configuration of a boat 10 according to a first preferred embodiment of the present invention. FIG. 1 and other figures described below show arrows representing each direction with respect to the position of the boat 10. More specifically, each drawing shows arrows representing the front direction (FRONT), rear direction (REAR), left direction (LEFT), right direction (RIGHT), upper direction (UPPER), and lower direction (LOWER), respectively. The front-rear direction, left-right direction, and up-down (vertical) direction are orthogonal to each other.

The boat 10 includes a hull 200 and an outboard motor 100. In this preferred embodiment, the boat 10 includes only one outboard motor 100, but the boat 10 may include a plurality of outboard motors 100.

The hull 200 is a portion of the boat 10 for occupants to ride. The hull 200 includes a hull main body 202 including a living space 204, a pilot seat 240 installed in the living space 204, and an operating device 250 installed near the pilot seat 240. The operating device 250 steers the boat and includes, e.g., a steering wheel 252, a shift/throttle lever 254, a joystick 255, a monitor 256, and an input device 258. The hull 200 includes a partition wall 220 to partition the rear end of the living space 204 and a transom 210 positioned at the rear end of the hull 200. In the front-rear direction, a space 206 is provided between the transom 210 and the partition wall 220.

Figure 2:
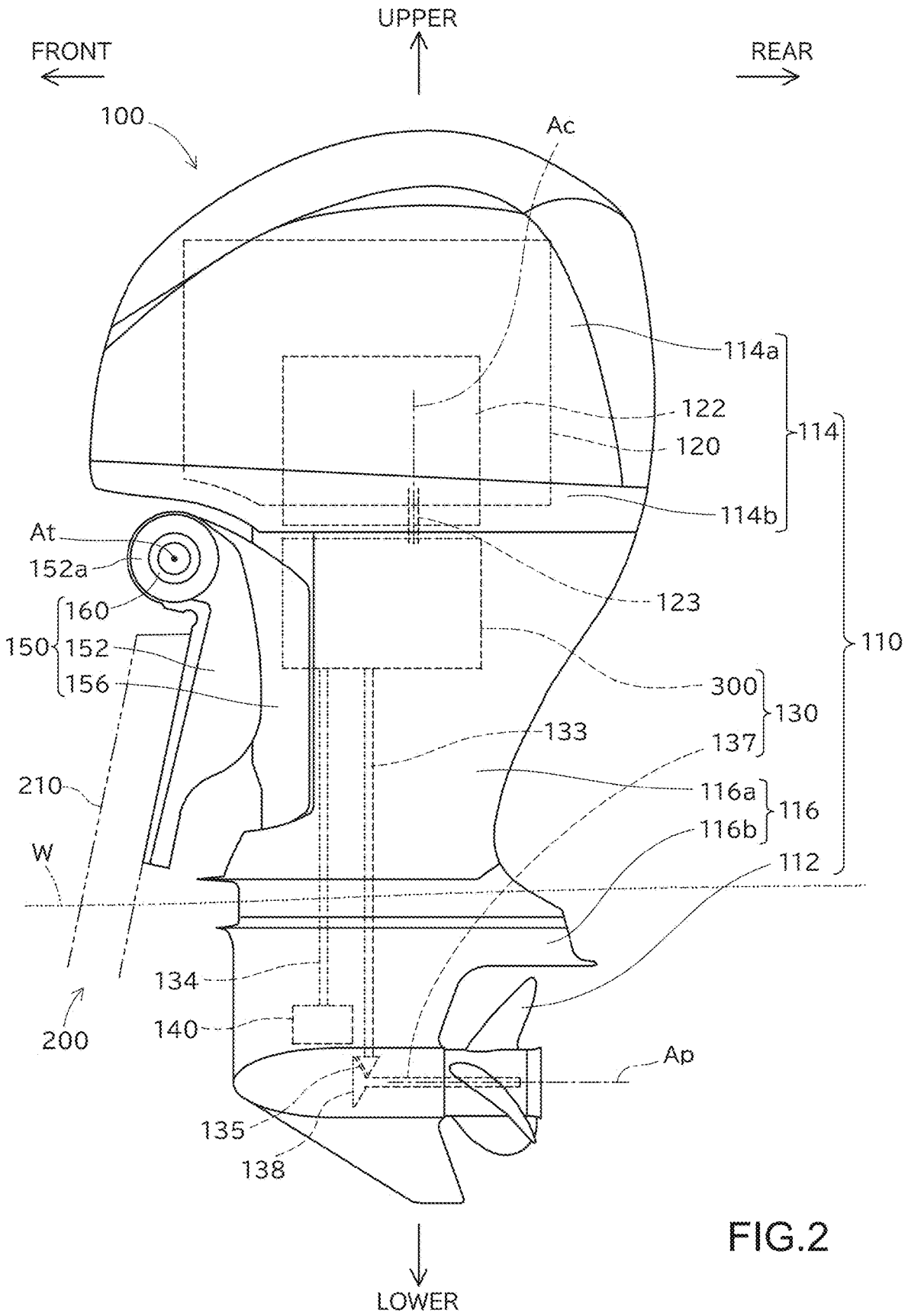
FIG. 2 is a side view schematically illustrating a configuration of an outboard motor according to the first preferred embodiment of the present invention.

FIG. 2 is a side view schematically illustrating a configuration of an outboard motor 100. The outboard motor 100 in the reference attitude will be described below unless otherwise specified. The reference attitude is an attitude in which the rotation axis Ac of the output shaft 123 of the electric motor 122, which will be described below, extends in the up-down direction and the rotation axis Ap of the propeller shaft 137, which will be described below, extends in the front-rear direction. The front-rear direction, the left-right direction, and the up-down direction are respectively defined based on the outboard motor 100 in the reference attitude.

The outboard motor 100 generates thrust to propel the boat 10. The outboard motor 100 is attached to the transom 210 at a rear portion of the hull 200. The outboard motor 100 includes an outboard motor main body 110 and a suspension device 150.

The outboard motor main body 110 includes a motor assembly 120, a transmission 130, a propeller 112, a cowl 114, a casing 116, a water pump 140, and a pump shaft 134.

The cowl 114 is a housing located on top of the outboard motor main body 110. The cowl 114 includes an upper cowl **114*a* defining an upper portion of the cowl 114 and a lower cowl 114*b* defining a lower portion of the cowl 114. The upper cowl 114*a* is detachably attached to the lower cowl 114*b***.

The casing 116 is a housing located below the cowl 114 and provided in the lower portion of the outboard motor main body 110. The casing 116 includes a lower case **116*b* and an upper case 116*a*. The lower case 116*b* accommodates at least a portion of the drive shaft 133 and the propeller shaft 137 described below. The lower case 116*b* is connected to the upper case 116*a* so as to be pivotable around the drive shaft 133. The upper case 116*a* is located above the lower case 116*b* and accommodates a gearbox assembly 300** described below.

A motor assembly 120 is accommodated within the cowl 114. The motor assembly 120 includes an electric motor 122. The electric motor 122 is an example of a drive source. The electric motor 122 includes an output shaft 123 that outputs the drive power generated by the electric motor 122.

The transmission 130 transmits the driving force of the electric motor 122 to the propeller 112. At least a portion of the transmission 130 is accommodated in the casing 116. The transmission 130 includes a gearbox assembly 300, a drive shaft 133, and a propeller shaft 137.

The propeller shaft 137 is a rod-shaped member and extends in a forward and backward orientation below the outboard motor main body 110. The propeller shaft 137 rotates with the propeller 112. The front end of the propeller shaft 137 is accommodated in the lower case **116*b*, and the rear end of the propeller shaft 137 protrudes rearward from the lower case 116*b*. The front end of the propeller shaft 137 includes a gear 138**.

The gearbox assembly 300 is connected to the output shaft 123 of the electric motor 122 and the drive shaft 133. The gearbox assembly 300 reduces the driving force of the electric motor 122 and transmits the reduced driving force to the propeller shaft 137. This allows the electric motor 122 to rotate at a desired torque.

The propeller 112 is a rotor including a plurality of blades and is attached to the rear end of the propeller shaft 137. The propeller 112 rotates along with the rotation of the propeller shaft 137 around the rotation axis Ap. The propeller 112 generates thrust by rotating. As mentioned above, since the lower case **116*b* is pivotable, the propeller 112 pivots about the drive shaft 133 along with the lower case 116*b*. Therefore, the boat 10 is steered by pivoting the lower case 116*b***.

The water pump 140 pumps water from outside the outboard motor 100, e.g., to cool the electric motor 122. The pump shaft 134 extends in an up-down direction. The pump shaft 134 is driven by the drive power of the electric motor 122 and transmits power to the water pump 140. The water pump 140 is driven by the driving force of the electric motor 122 transmitted by the pump shaft 134.

The suspension device 150 connects the outboard motor main body 110 to the hull 200. The suspension device 150 includes a pair of left and right clamp brackets 152, a tilt shaft 160, and a swivel bracket 156.

The pair of left and right clamp brackets 152 are disposed behind the hull 200 in a state separated from each other in the left-right direction and are fixed to the transom 210 of the hull 200 by using, e.g., bolts. Each clamp bracket 152 includes a cylindrical supporting portion 152*a* provided with a through-hole extending in the left-right direction.

The tilt shaft 160 is a rod-shaped member and is rotatably supported within the through-hole in the supporting portion 152*a* of the clamp bracket 152. The tilt axis At, which is the centerline of the tilt shaft 160, defines a horizontal (left-right) axis during the tilting operation of the outboard motor 100.

The swivel bracket 156 is sandwiched between the pair of clamp brackets 152 and is supported by the supporting portion 152*a* of the clamp brackets 152 via the tilt shaft 160 so as to be rotatable around the tilt axis At. The swivel bracket 156 is driven to rotate about the tilt axis At with respect to the clamp bracket 152 by a tilt device (not shown) that includes an actuator, such as a hydraulic cylinder, for example.

When the swivel bracket 156 rotates about the tilt axis At with respect to the clamp bracket 152, the outboard motor main body 110 supported by the swivel bracket 156 also rotates about the tilt axis At. This achieves the tilting operation of rotating the outboard motor main body 110 in the up-down direction with respect to the hull 200. By this tilting operation, the outboard motor 100 can change the angle of the outboard motor main body 110 around the tilt axis At in the range from the tilt-down state in which the propeller 112 is located under the water (the state in which the outboard motor 100 is in the reference attitude) to the tilt-up state in which the propeller 112 is located above the water surface. Trimming operation to adjust the attitude of the boat 10 during travel can also be performed by adjusting the angle around the tilt axis At of the outboard motor main body 110.

Figure 3:
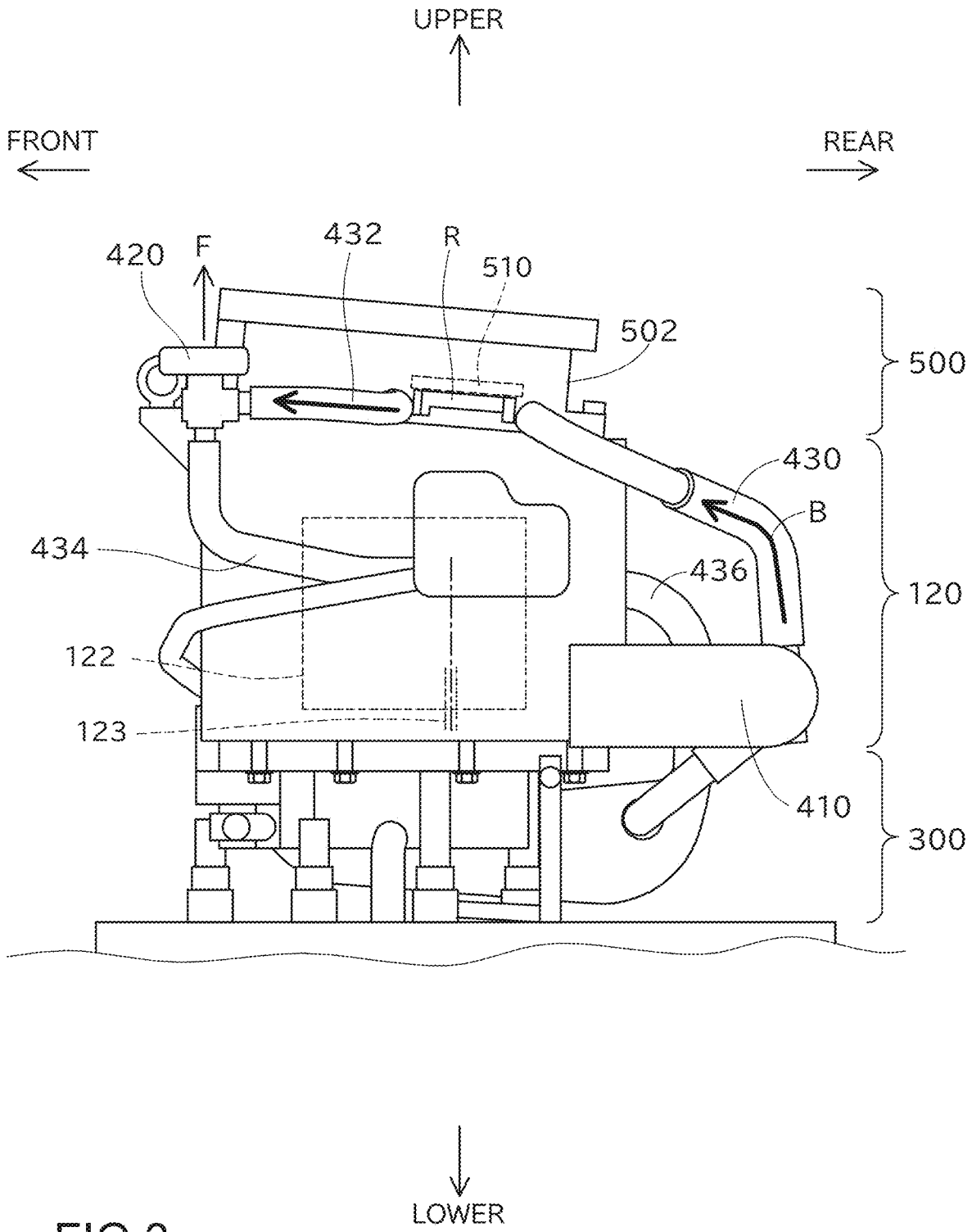
FIG. 3 is a side view schematically illustrating a portion of an internal configuration of an outboard motor main body.

FIG. 3 is a side view schematically illustrating a portion of an internal configuration of an outboard motor main body 110. FIG. 3 shows the internal structure accommodated in the cowl 114 and the upper portion of the upper case 116*a*. As shown in FIG. 3, the motor assembly 120 is located above the gearbox assembly 300, and the control assembly 500 is located above the motor assembly 120.

The motor assembly 120 includes the electric motor 122 described above. The electric motor 122 is placed vertically in the motor assembly 120. Vertical placement means that the output shaft 123 of the electric motor 122 is arranged in an attitude in which the output shaft 123 of the electric motor 122 extends in the up-down direction.

The control assembly 500 includes an MCU (Motor Control Unit) 510 accommodated in a control case 502. The MCU 510 may be a circuit board that controls the rotation, among other functions, of the electric motor 122. The MCU 510 is an example of a motor control board and a control board.

The internal configuration of the outboard motor main body 110 further includes a cooling device 400. The cooling device includes a heat exchanger (not shown), a pump 410, an air vent 420, a first refrigerant tube 430, a second refrigerant tube 432, a third refrigerant tube 434, a fourth refrigerant tube 436, and a seawater tube (not shown).

The seawater pumped by the water pump 140 is sent to the heat exchanger through the seawater pipe and discharged back to the sea. A cooling water B (coolant) is cooled by heat exchange with seawater in the heat exchanger and is sent to the pump 410 via the fourth refrigerant tube 436. The pump 410 pumps the cooling water B to the first refrigerant tube 430. The pumped cooling water B is supplied to the cooling chamber R in the control case 502 via the first refrigerant tube 430. As described below, the cooling chamber R is located directly under the MCU 510, and the MCU 510 is cooled by the cooling water B supplied to the cooling chamber R. The cooling water B is an example of a refrigerant and may be, e.g., seawater.

The cooling water B supplied to the cooling chamber R is discharged into the second refrigerant tube 432. The discharged cooling water B returns to the heat exchanger via the third refrigerant tube 434. The third refrigerant tube 434 is located around the electric motor 122. Therefore, the electric motor 122 is cooled by the cooling water B flowing through the third refrigerant tube 434. An air vent 420 is provided at the connecting portion between the second refrigerant tube 432 and the third refrigerant tube 434. The air vent 420 removes air contained in the second refrigerant tube 432 and the third refrigerant tube 434 or in the cooling water B that passes through them to the outside.

Figure 4:
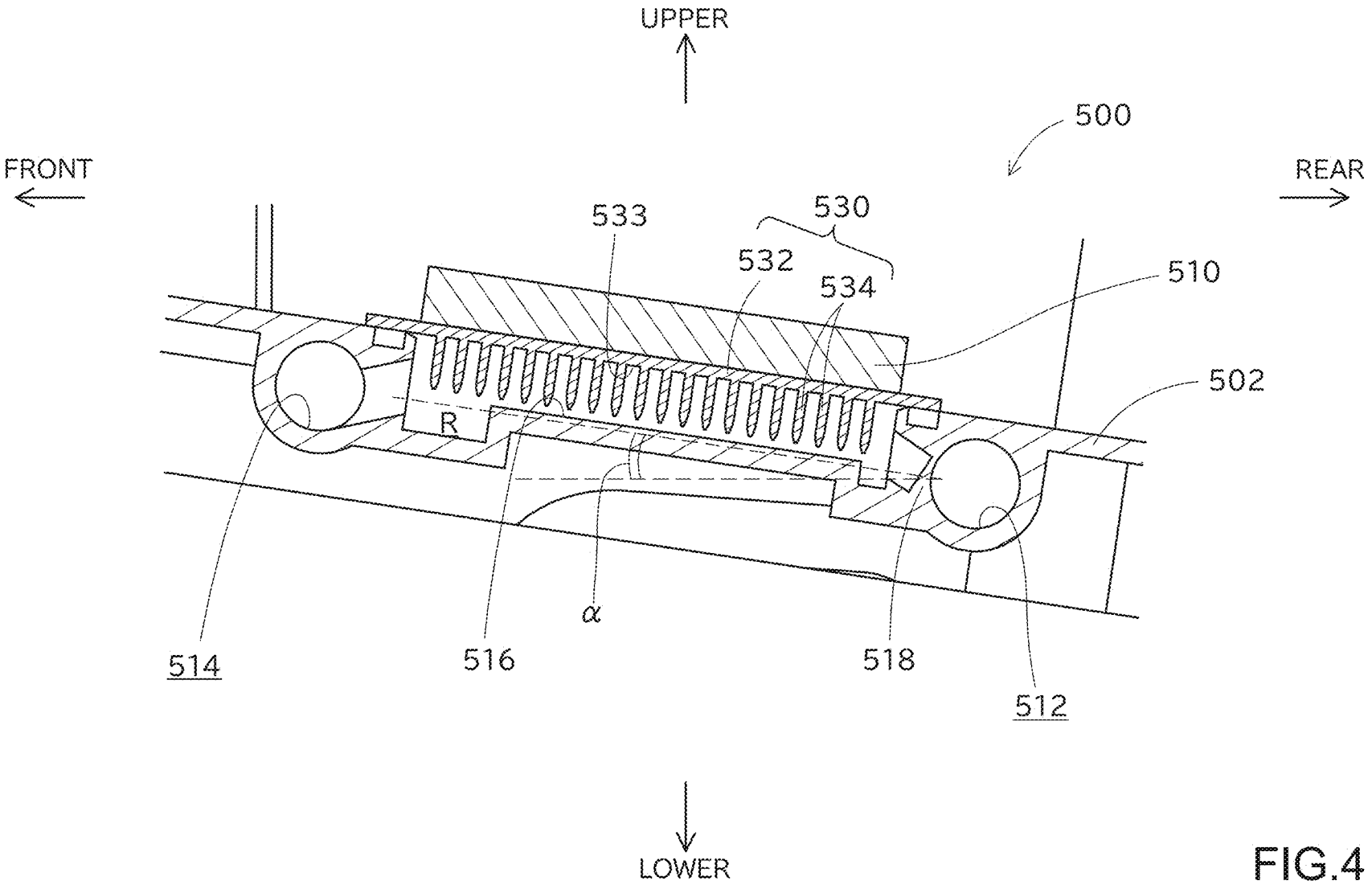
FIG. 4 is a cross-sectional view illustrating a peripheral configuration of an MCU (Motor Control Unit).
Figure 5:
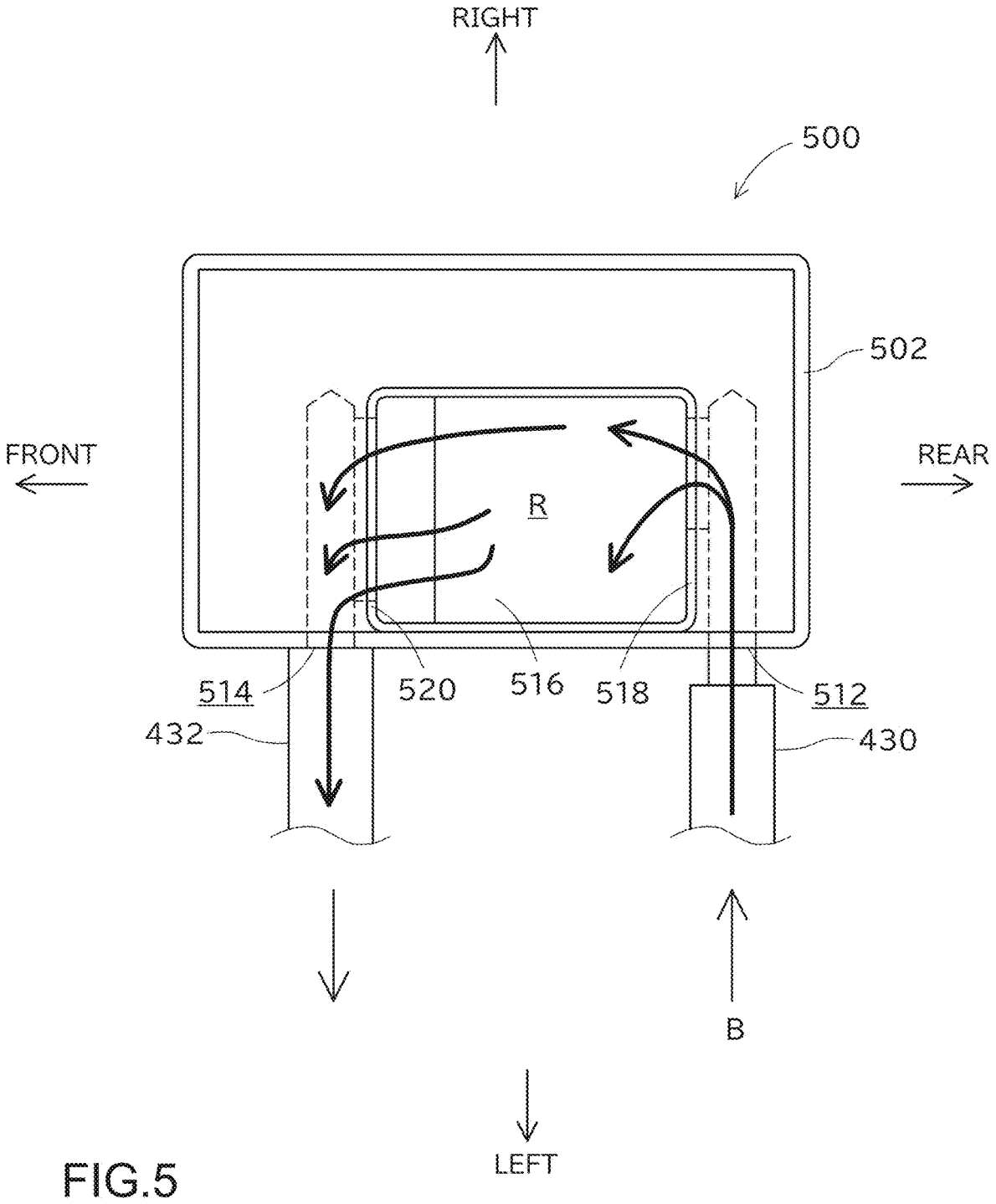
FIG. 5 is a top view illustrating a configuration of a cooling chamber in a control case.

FIG. 4 is a cross-sectional view illustrating a peripheral configuration of the MCU 510, and FIG. 5 is a top view illustrating a configuration of the cooling chamber R in the control case 502. As shown in FIG. 4, the MCU 510 is a rectangular flat control board and is arranged along a direction inclined by an angle $\alpha$ (0 degrees$<\alpha<$90 degrees) with respect to the horizontal direction in the control case 502. The angle $\alpha$ may be about 3 degrees or more, about 5 degrees or more, about 10 degrees or more, about 15 degrees or more, about 20 degrees or more, or about 30 degrees or more, for example. The angle $\alpha$ may be about 5 degrees or less, about 10 degrees or less, about 15 degrees or less, about 20 degrees or less, or about 30 degrees or less. The control case 502 is an example of a case.

The cooling chamber R is provided in the portion of the control case 502 between the MCU 510 and the electric motor 122. The cooling chamber R is a rectangular flat space and is open to a side of the MCU 510. The cooling chamber R is inclined so to be parallel or substantially parallel to the MCU 510. A heat sink plate 530 is provided under the MCU 510. The heat sink plate 530 includes a rectangular plate-shaped base 532 and a plurality of projections 534 protruding from the lower surface 533 of the base 532. The heat sink plate 530 is arranged to cover the upper opening of the cooling chamber R. In other words, the lower surface 533 of the base 532 defines a top surface of the cooling chamber R. The upper surface of base 532 is in contact with the entire lower surface of MCU 510. The heat sink plate 530 is also inclined to be parallel or substantially parallel to the MCU 510.

The cooling chamber R includes a supply port 512 and a discharge port 514. The lower end of the discharge port 514 is located higher than the lower end of the supply port 512. In other words, the supply port 512 is located at the lowest end of the cooling chamber R (right end of the cooling chamber R in FIG. 4, for example) and is connected to the flow path in the first refrigerant tube 430. The discharge port 514 is located at the highest end of the cooling chamber R (left end of the cooling chamber R in FIG. 4, for example) and is connected to the flow path in the second refrigerant tube 432. The flow path in the first refrigerant tube 430 is an example of a supply flow path, and the flow path in the second refrigerant tube 432 is an example of a discharge flow path.

The lower surface 533 of the base 532 of the heat sink plate 530, which defines the top surface of the cooling chamber R (the surface on which the projections 534 are not provided), extends along the MCU 510 in a direction inclined by the angle α with respect to the horizontal direction. In this preferred embodiment, the bottom surface 516 of the cooling chamber R also extends along the MCU 510 in a direction inclined by the angle α with respect to the horizontal direction. Thus, in this preferred embodiment, the lower surface 533 of the base 532 and the bottom surface 516 are parallel or substantially parallel to each other. The lower surface 533 of the base 532 is an example of a first wall surface, and the bottom surface 516 is an example of a second wall surface.

As shown in FIG. 5, a supply direction of the cooling water B from the first refrigerant tube 430 to the cooling chamber R (right direction) is opposite to a discharge direction of the cooling water B from the cooling chamber R to the second refrigerant tube 432 (left direction). Specifically, both the supply port 512 and the discharge port 514 open from the cooling chamber R in the same direction (left direction). Therefore, the cooling water B supplied from the first refrigerant tube 430 flows toward the right side wall of the cooling chamber R. On the other hand, the cooling water B supplied to the cooling chamber R flows out toward the discharge port 514 provided on the left side wall of the cooling chamber R. This allows the MCU 510 to be effectively cooled while reducing turbulence caused by the momentum of the flow of the cooling water B from the first refrigerant tube 430 to the cooling chamber R and discharging the cooling water B from the cooling chamber R.

The cooling chamber R includes a first partition wall 518 and a second partition wall 520. The first partition wall 518 is positioned closer to the supply port 512 and extends continuously from the inner wall surface (left side wall) where the supply port 512 is provided to the middle of the cooling chamber R along the supply direction of the first refrigerant tube 430. The cooling water B supplied from the first refrigerant tube 430 is guided by the first partition wall 518 to the far side (right side) of the cooling chamber R. Since the cooling water B is supplied to the far side of the cooling chamber R, the entire surface of the MCU 510 can be effectively cooled.

The second partition wall 520 is positioned closer to the discharge port 514 and extends continuously from the inner wall surface (left side wall) where the discharge port 514 is provided to the middle of the cooling chamber R along the supply direction described above. The second partition wall 520 reduces the amount of cooling water B that is discharged without extending to the far side of the cooling chamber R. The length of the second partition wall 520 is shorter than the length of the first partition wall 518. Therefore, it is possible to easily discharge the cooling water B from the cooling chamber R due to the presence of the second partition wall 520.

The supply port 512 is located at the highest point in the first refrigerant tube 430 (see FIGS. 3 and 4). Therefore, the cooling water B is filled from the first refrigerant tube 430 to the cooling chamber R in order. Therefore, the cooling chamber R can be filled smoothly with cooling water B compared to a configuration in which, e.g., the supply port 512 is not located at the highest point in the first refrigerant tube 430.

The discharge port 514 is located at the lowest point in the second refrigerant tube 432. This prevents the cooling water B from being discharged into the second refrigerant tube 432 without the cooling chamber R being sufficiently filled with the cooling water B. This configuration can vent air in the cooling chamber more smoothly compared to a configuration in which the discharge port is not located at the lowest point in the discharge flow path.

It should be noted that, in this specification, axes, members, and the like extending in the front-rear direction need not necessarily be parallel to the front-rear direction. Axes and members extending in the front-rear direction include axes and members that are inclined in the range of ±45° to the front-rear direction. Similarly, axes and members extending in the up-down direction include axes and members inclined within a range of ±45° to the up-down direction, and axes and members extending in the left-right direction include axes and members inclined within a range of ±45° to the left-right direction.

The techniques disclosed herein are not limited to the above-described preferred embodiments and may be modified in various ways without departing from the gist of the present invention, including the following modifications.

The configuration of the boat 10 and outboard motor 100 of the preferred embodiments is only an example and may be variously changed. For example, in the above preferred embodiments, the drive shaft 133 is positioned in front of the output shaft 123, but the drive shaft 133 may be positioned behind the output shaft 123. In the above preferred embodiments, an electric motor 122 with the output shaft 123 disposed along the up-down direction is shown as the drive source, but the drive source may be an electric motor with the output shaft 123 disposed along a direction other than the up-down direction (e.g., horizontal direction) or an engine such as internal combustion engine.

In the above preferred embodiments, the MCU 510 is illustrated as a control board, but the control board may be a board that controls components other than the electric motor 122. The control board need not be located near the electric motor 122. In the above preferred embodiments, the lower surface 533 of the heat sink plate 530 and the bottom surface of the MCU 510 are parallel or substantially parallel to each other, but they may be non-parallel. In the above preferred embodiments, the lower surface 533 of the base 532 and the bottom surface 516 are parallel or substantially parallel to each other, but they may be non-parallel. The first wall surface (lower surface 533 of the heat sink plate 530) of the control board (motor control board) may be a flat surface or may have an uneven or curved surface. It is sufficient if the first wall as a whole extends along the control board.

In the above preferred embodiments, the supply direction of refrigerant B from the supply flow path (first refrigerant tube 430) to the cooling chamber R and the discharge direction of refrigerant B from the cooling chamber R to the discharge flow path (second refrigerant tube 432) may be in the same direction or cross each other. In the above preferred embodiments, the supply port 512 may not be located at the highest point in the supply flow path, or the discharge port 514 may not be located at the lowest point in the discharge flow path. In the above preferred embodiments, at least one of the first partition wall 518 and the second partition wall 520 may not be provided in the cooling chamber R.

In the above preferred embodiments, the MCU 510 is arranged along a direction inclined by an angle α (0 degrees<α<90 degrees) with respect to the horizontal direction, but the configuration is not limited to this, e.g., the MCU 510 may be arranged along an up-down direction. In this case, it is preferable that the surface of the heat sink plate 530 on the cooling chamber R is also parallel or substantially parallel to the MCU 510.

In the above preferred embodiments, in the casing 116, the lower case 116*b* is connected to the upper case 116*a* so that the lower case 116*b* is rotatable, but the lower case 116*b* does not necessarily have to be rotatable. The casing 116 need not include an upper case 116*a* and a lower case 116*b* but may be a single member.

In the above preferred embodiments, the outboard motor 100 is provided with the water pump 140 as a driven device, but it may not be provided with the water pump 140 or may be provided with another driven device instead of the water pump 140.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an electric motor;

a motor control board, a first end of which is located higher than a second end and is configured to control the electric motor;

a case between the electric motor and the motor control board and including a cooling chamber;

a supply flow path connected to the cooling chamber of the case to supply refrigerant to the cooling chamber; and a discharge flow path connected to the cooling chamber of the case to discharge the refrigerant from the cooling chamber; wherein a discharge port of the discharge flow path in the cooling chamber is located at the first end of the motor control board, a supply port of the supply flow path in the cooling chamber is located at the second end of the motor control board, a lower end of the discharge port is higher than a lower end of the supply port, and among inner wall surfaces of the cooling chamber, a first wall surface adjacent to the motor control board extends along the motor control board;

the motor control board and the first wall surface of the cooling chamber are inclined with respect to a horizontal direction.

2. The outboard motor according to claim 1, wherein a second wall surface of the cooling chamber is located on an opposite side of the cooling chamber from the motor control board and is inclined in a same direction as the first wall surface of the cooling chamber with respect to the horizontal direction.

3. The outboard motor according to claim 1, wherein the motor control board and the first wall surface of the cooling chamber extend along an up-down direction.

4. The outboard motor according to claim 1, wherein a supply direction of the refrigerant from the supply flow path to the cooling chamber is opposite to a discharge direction of the refrigerant from the cooling chamber to the discharge flow path.

5. The outboard motor according to claim 1, wherein the supply port is located at a highest point in the supply flow path.

6. The outboard motor according to claim 1, wherein the discharge port is located at a lowest point in the discharge flow path.

7. The outboard motor according to claim 1, further comprising:

an air vent higher than the discharge port; and the discharge flow path is connected to the air vent.

8. A boat comprising:

a hull; and the outboard motor according to claim 1 mounted to a rear portion of the hull.

9. An outboard motor comprising:

a control board oriented such that one end is lower than another end;

a case extending along the control board and including a cooling chamber;

a supply flow path connected to the cooling chamber of the case to supply a refrigerant to the cooling chamber; and a discharge flow path connected to the cooling chamber of the case to discharge the refrigerant from the cooling chamber; wherein a discharge port of the discharge flow path in the cooling chamber is higher than a supply port of the supply flow path in the cooling chamber, and among inner wall surfaces of the cooling chamber, a wall surface of the cooling chamber adjacent to the control board extends along the control board from the discharge port to the supply port; and the control board and the wall surface of the cooling chamber are inclined with respect to a horizontal direction.

* * * * *